US005288941A

United States Patent [19]

Sekizuka

[11] Patent Number: 5,288,941

[45] Date of Patent: Feb. 22, 1994

[54] ELECTRONIC MUSICAL INSTRUMENT WITH SIMPLIFIED OPERATION FOR SETTING NUMEROUS TONE PARAMETERS

[75] Inventor: Makoto Sekizuka, Iwata, Japan

[73] Assignee: Kabushiki Kaisha Kawai Gakki Seisakusho, Shizuoka, Japan

[21] Appl. No.: 920,669

[22] Filed: Jul. 28, 1992

[30] Foreign Application Priority Data

Aug. 1, 1991 [JP] Japan ..... 3-215798

[51] Int. Cl.[5] ..... G10H 7/00

[52] U.S. Cl. ..... 84/615; 84/602; 84/478; 84/626

[58] Field of Search ..... 84/602, 615, 633, 644, 84/653, 665, 670, DIG. 7, 626, 478, 601, 477 R, 480

[56] References Cited

U.S. PATENT DOCUMENTS 4,432,265 2/1984 Oya et al. ..... 84/615
4,791,847 12/1988 Nishimoto ..... 84/615
4,829,869 5/1989 Katoda et al. ..... 84/615
4,957,552 9/1990 Iwase ..... 84/615
4,961,363 10/1990 Mizuno et al. ..... 84/615
5,179,238 1/1993 Hotta ..... 84/478

*Primary Examiner*—William M. Shoop, Jr.
*Assistant Examiner*—Helen Kim

[57] ABSTRACT

A parameter setting apparatus, which can independently set parameter values for controlling tones in units of parameters. Operation member sets, each including UP and DOWN operation members and a PRESET operation member, are arranged on an operation panel (2) in correspondence with parameters. When a user depresses a given PRESET operation member, a preset value supplier (21) reads out a preset value of the corresponding parameter from preset data stored in a preset memory (6), and supplies the readout value to a working memory (5), thereby rewriting the value of the corresponding one of parameters stored in the working memory (5) with the readout preset value. Upon operation of an UP or DOWN operation member, the value of the corresponding parameter in the working memory (5) is incremented or decremented.

9 Claims, 4 Drawing Sheets

ELECTRONIC MUSICAL INSTRUMENT WITH SIMPLIFIED OPERATION FOR SETTING NUMEROUS TONE PARAMETERS

BACKGROUND OF THE INVENTION

1. Field of the Invention

The present invention relates to a parameter setting apparatus for an electronic musical instrument, which sets various parameters for controlling tones generated by the electronic musical instrument.

2. Description of the Related Art

In general, tone colors, tone volumes, tone pitches, effects, and the like of tones generated by an electronic musical instrument such as an electronic keyboard, a synthesizer, or the like are controlled according to preset parameters (variable control data). Upon setting of the parameters, a parameter setting apparatus is used.

In a conventional parameter setting apparatus, initial data are read out from a memory such as a ROM upon power-ON, and parameters are set on the basis of the readout data. When a parameter value is to be changed, an operation member for incrementing/decrementing the parameter value is operated to increment or decrement the parameter value step by step. In an apparatus which can use preset data upon setting of parameters, a user changes parameter values in advance, and stores the changed values in a memory as preset data. When the user operates an operation member called a registration switch, parameters are set on the basis of the stored preset data.

In the conventional parameter setting apparatus, when parameters are set on the basis of preset data, the parameter values cannot be independently preset. More specifically, when the registration switch is operated, all the parameter values are simultaneously set as preset values on the basis of the preset data, and only a specific parameter value cannot be set as a preset value.

SUMMARY OF THE INVENTION

It is, therefore, an object of the present invention to provide a parameter setting apparatus, which can independently preset parameter values in units of parameters.

It is another object of the present invention to provide a parameter setting apparatus, which can easily perform a selection operation and a preset operation of a parameter to be set by a single operation with one finger.

In order to achieve the above objects, according to the present invention, there is provided a parameter setting apparatus for an electronic musical instrument, which sets various parameters for controlling tones, comprising: a plurality of parameter value setting means arranged in correspondence with the parameters, each of the plurality of parameter value setting means including an operation member for incrementing a parameter value, an operation member for decrementing a parameter value, and an operation member for instructing to set a preset value as a parameter value.

There is also provided a parameter setting apparatus for an electronic musical instrument, which sets various parameters for controlling tones, comprising: a plurality of parameter value setting means arranged on an operation panel in correspondence with the parameters, each of the plurality of parameter value setting means including an operation member for incrementing a parameter value, an operation member for decrementing a parameter value, and an operation member for instructing to set a preset value as a parameter value; increment/decrement means for, when the operation member for incrementing or decrementing the parameter value is operated, incrementing or decrementing the corresponding parameter value; and preset value setting means for, when the operation member for instructing to set the preset value is operated, setting the preset value as the parameter value.

When a user wants to select a preset value as a parameter value, he or she need only depress with one finger an operation member, which instructs to set the preset value as the parameter value, of an operation member set corresponding to the parameter which is set to be the preset value, thereby setting the preset value as the parameter value.

DETAILED DESCRIPTION OF THE PREFERRED EMBODIMENT

The preferred embodiment of the present invention will be described below with reference to the accompanying drawings.

Figure 1:
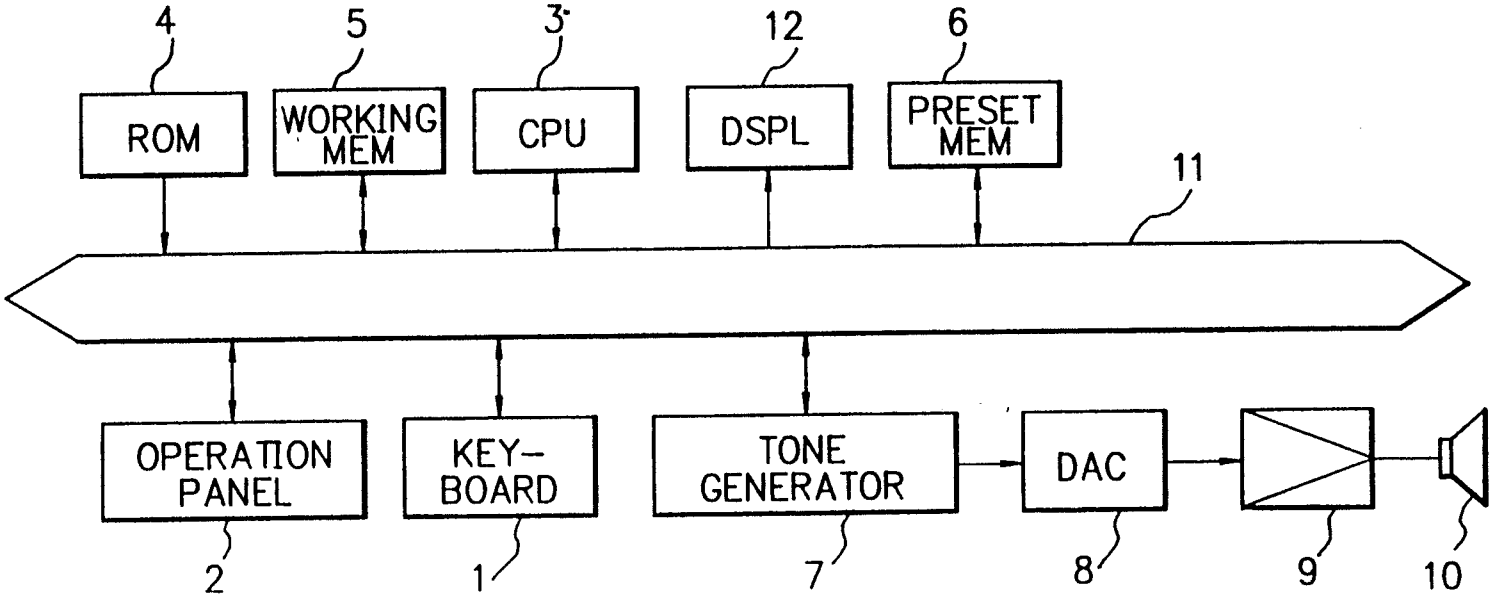
FIG. 1 is a schematic block diagram for explaining an arrangement of an electronic musical instrument such as an electronic keyboard, which adopts the present invention.

FIG. 1 is a schematic block diagram for explaining an arrangement of an electronic musical instrument such as an electronic keyboard, which adopts the present invention.

In FIG. 1, a keyboard 1, an operation panel 2, a CPU 3, a ROM 4, a working memory 5, a preset memory 6, and a tone generator 7 are connected to a bus line 11 including a data bus, an address bus, and the like so as to exchange data with each other.

The keyboard 1 comprises one or plurality of keyboards each including a plurality of keys and key switches in correspondence with the keys. The key switch detects ON and OFF key events, and can also detect a key operation speed.

The operation panel 2 includes a ten-key pad for inputting a numerical value, a display for displaying various kinds of information, operation members for setting various parameters such as tone color, tone volume, effects, and the like, operation members for instructing an auto-play operation based on auto-play data, and the like.

Figure 2:
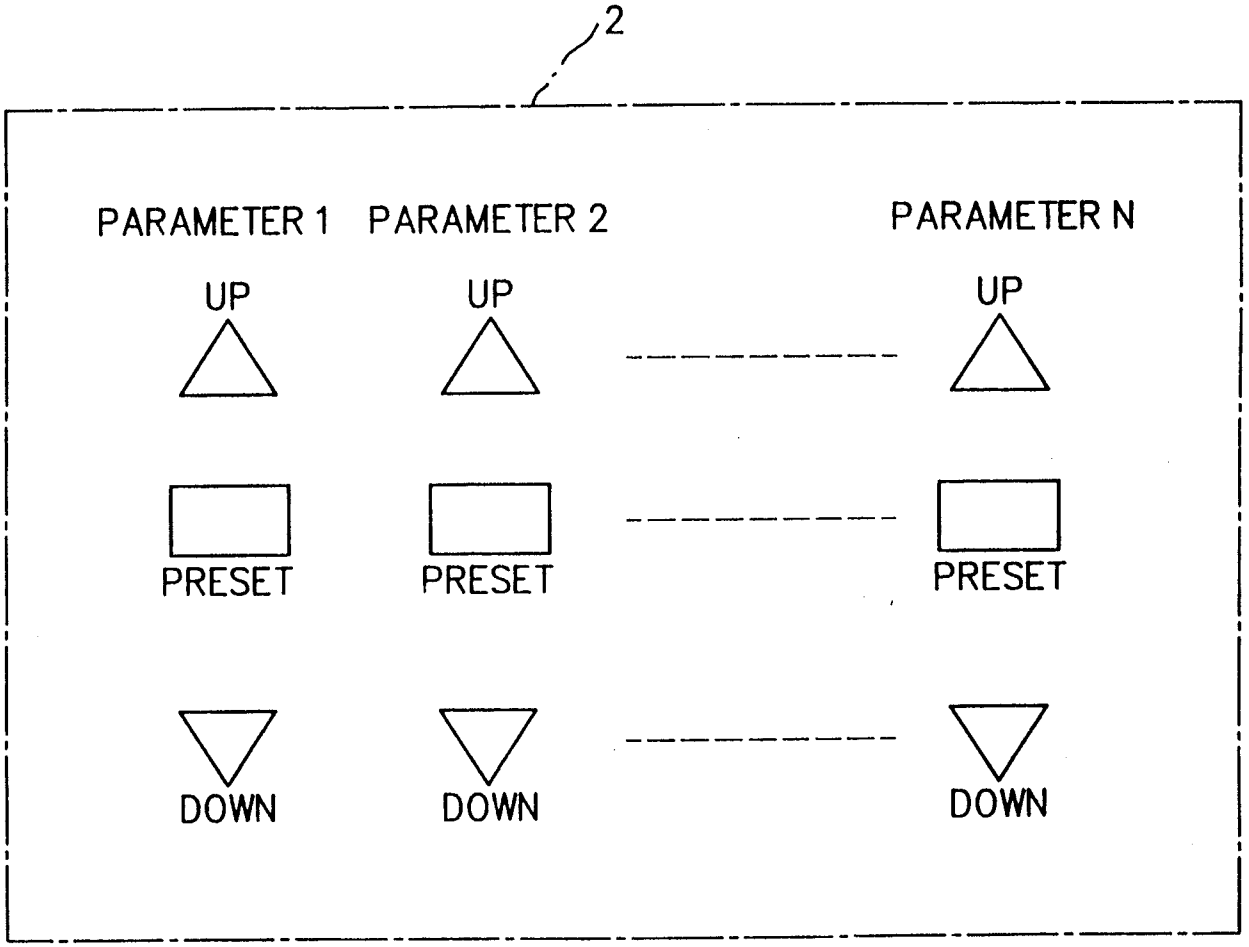
FIG. 2 is a view for explaining operation members arranged on an operation panel.

The operation members for setting the parameters such as tone color are arranged, as shown in FIG. 2. More specifically, operation member sets, each including an UP operation member for incrementing a parameter value, a DOWN operation member for decrementing a parameter value, and a PRESET operation member for setting a preset value as a parameter value, are arranged in correspondence with the parameters such as tone color, tone volume, and the like. More specifically, for example, if a parameter 1 represents a tone color parameter, UP, DOWN, and PRESET operation members are prepared for setting the value of this tone color parameter. Every time the UP or DOWN operation member is depressed, the current value of the tone color parameter is incremented or decremented step by step. When one of these operation members is continuously depressed, the parameter value is continuously incremented or decremented. When the PRESET operation member is depressed, a preset value set by a user in advance is set as the tone color parameter. When one of the UP, DOWN, and PRESET operation members is depressed, the incremented/decremented parameter value or the preset parameter value is displayed on a display 12. A user increments/decrements the parameter value while observing the parameter value displayed on the display 12.

The CPU 3 executes scan processing of the key switches of the keyboard 1 and scan processing of the operation members of the operation panel 2 according to a program stored in the ROM 4, and detects the operation state (an ON or OFF key event, a key number of the operated key, a velocity associated with a key operation speed, and the like) of each key of the keyboard 1, and the operation state of each operation member of the operation panel 2. The CPU 3 then executes various processing operations according to the operation of the key or operation member.

The ROM 4 stores a work program of the CPU 3, tone waveform data, and display data for the display, and also stores auto-play data used in an auto-play operation. The auto-play data includes a set of melody, chord, bass, and drum part auto-play data, and is stored in units of rhythm types. The ROM 4 also stores initial data for setting parameters such as tone color, tone volume, effects, and the like.

The working memory 5 has a storage area for temporarily storing various kinds of information during execution of various processing operations by the CPU 3, and for storing information as results of the various processing operations, and a storage area in which parameter data for setting and controlling the tone color, tone volume, tone pitches, effects, and the like of tones to be generated by this electronic musical instrument are set. When the parameter data set in this area are supplied to the tone generator 7 (to be described later), the tone color, and the like of tones to be generated are controlled.

The preset memory 6 comprises a battery backup RAM or a nonvolatile RAM. The memory 6 stores parameter data supplied as initial data from the ROM 4 upon power-ON, or parameter data, whose numerical values are arbitrarily selected by a user, as preset data.

The tone generator 7 comprises a plurality of tone generation channels, and can simultaneously generate a plurality of tones. The tone generator 7 forms digital tone data on the basis of key number information representing each key, tone parameter information set upon operation of the operation members, and the like supplied from the CPU 3. Note that the tone generator 7 includes a digital filter, a digital effect addition circuit, and the like.

Tone data generated by the tone generator 7 is converted into an analog tone signal by a D/A converter 8. The tone signal is amplified by an amplifier 9, and the amplified signal is supplied to a loudspeaker 10.

Figure 3:
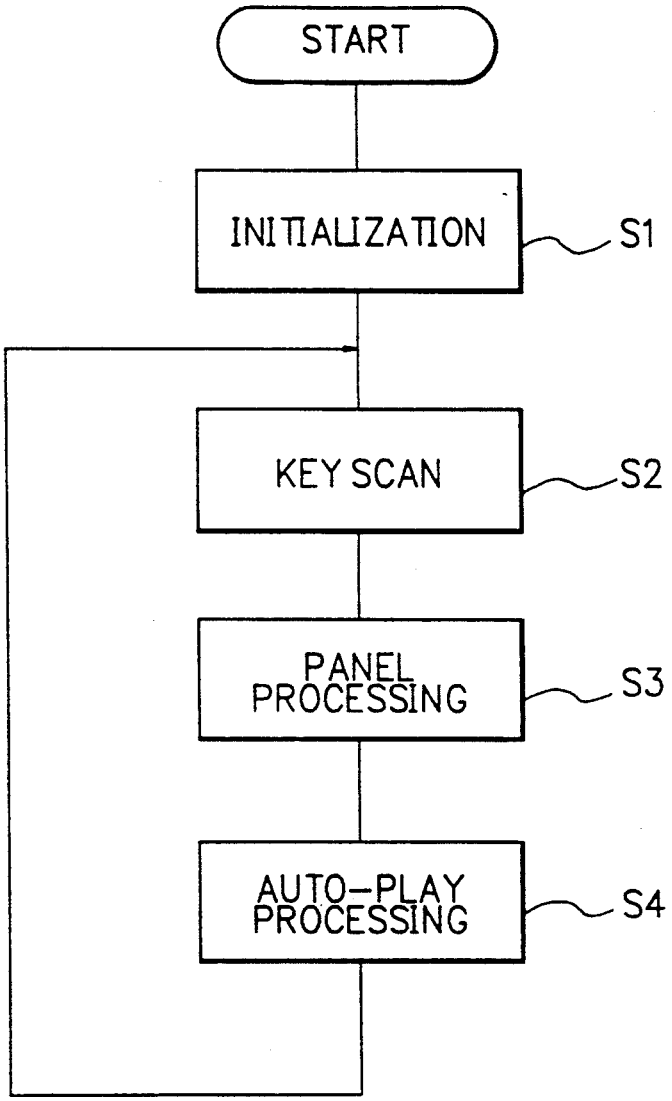
FIG. 3 is a flow chart showing a processing sequence of main processing executed by a CPU.

FIG. 3 is a flow chart showing a processing sequence of main processing executed by the CPU 3.

When the power switch of this electronic musical instrument is turned on, the CPU 3 performs initial processing in step S1. In this initial processing, the CPU 3 initializes the tone generator (tone source), clears the working memory 5, transfers initial data from the ROM 4 to the working memory 5 and the preset memory 6, and so on.

In step S2, the CPU 3 performs key scan processing for sequentially checking the operation states of all the keys of the keyboard 1. When the CPU 3 detects a key event, it performs tone-ON processing, tone-OFF processing, or the like corresponding to the detected key event.

In step S3, the CPU 3 performs key scan processing for sequentially checking the operation states of all the operation members of the operation panel 2. When the CPU 3 detects an operation member event, it performs processing corresponding to the detected event. Thereafter, the flow advances to step S4 to check if a play mode of auto-play data is set. If the play mode is set, the auto-play data is played. Thereafter, the flow returns to step S2, and the above-mentioned processing is repeated.

Figure 4:
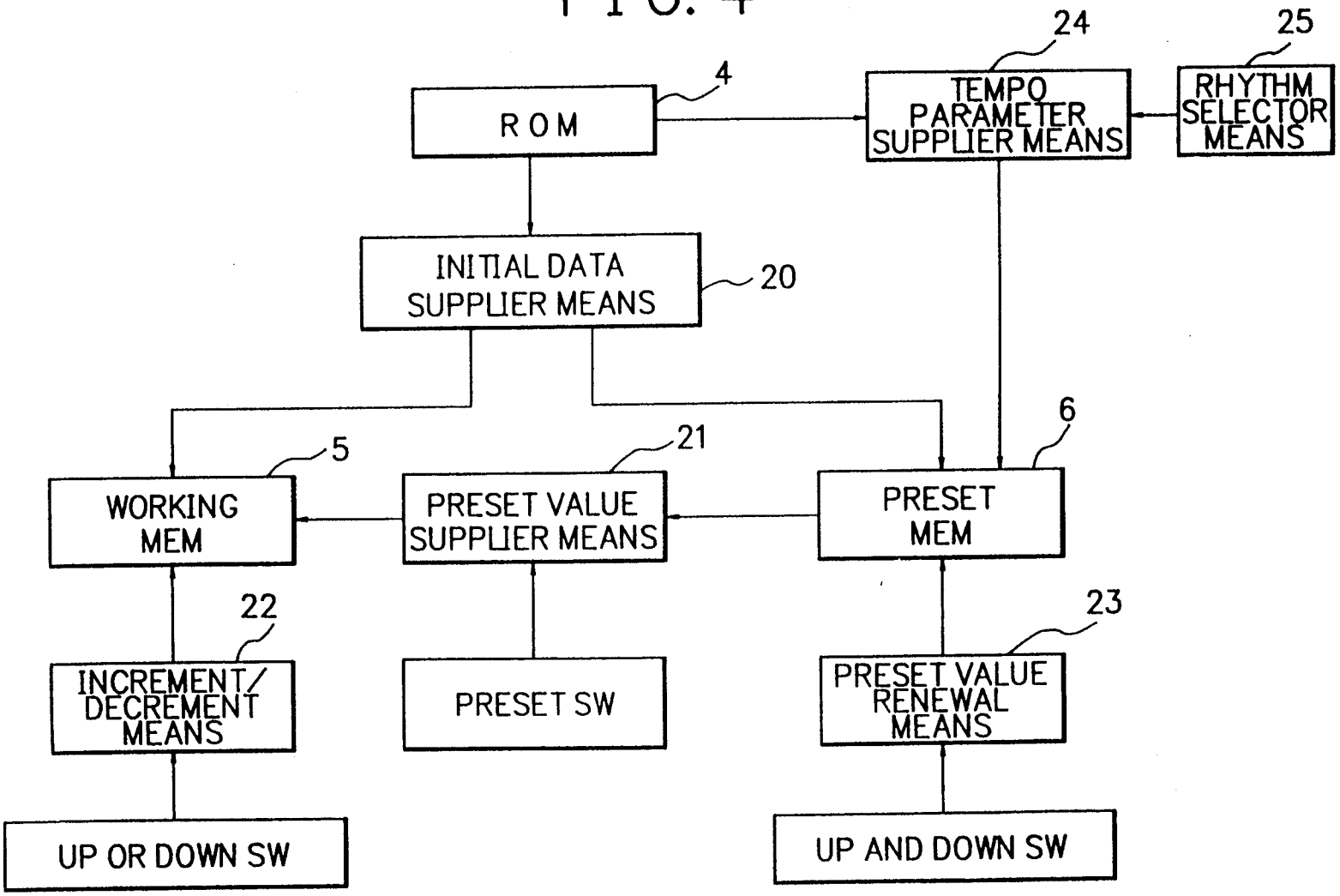
FIG. 4 is a diagram for explaining a parameter setting operation.

FIG. 4 is a diagram for explaining the outline of a parameter setting operation. In FIG. 4, an initial data supplier means 20, a preset value supplier means 21, an increment/decrement means 22, a preset value renewal means 23, and a tempo parameter supplier means 24 are realized by the CPU 3 and a program in the ROM 4.

In the initial processing in step S1 in FIG. 3, the initial data supplier means 20 reads out parameter data including of parameter groups such as tone color, tone pitch, effects, tone volumes, and the like as initial data from the ROM 4, and supplies the readout data to the working memory 5 and the preset memory 6. At this time, the parameter data to be supplied to the working memory 5 are tone color parameters, tone volume parameters, and the like, which have values set in advance by the manufacturer, so that balanced tones can be generated. On the other hand, the parameter data to be supplied to the preset memory 6 are tone color parameters, and the like, which have, e.g., center values. Tempo parameters are specially processed. That is, as for the tempo parameters, when a rhythm number for designating a rhythm is selected by a rhythm selector means 25 comprising, e.g., a ten-key pad, tempo parameter data most suitable for the selected rhythm are read out from the ROM 4 by the tempo parameter supplier means 24, and the readout data are supplied to the preset memory 6. Therefore, when tempo parameter data are read out from the memory 6, and are set in the working memory 5 upon operation of a PRESET operation member, a play operation can be performed with a tempo most suitable for the rhythm of the current play operation. Upon supply of the initial data, the same parameter data may be supplied to the working memory 5 and the preset memory 6. Alternatively, after the parameter data are temporarily supplied to the preset memory 6, the parameter memory may be transferred to the working memory 5.

A user switches a mode of this electronic musical instrument to a data edit mode using a mode selection button on the operation panel, and operates the UP or DOWN operation member to change the value of a desired parameter stored in the preset memory 6. Upon completion of the change operation of the parameter value, when the user simultaneously depresses the UP and DOWN operation members, the preset value renewal means 23 renews the value of the corresponding parameter data.

The tone colors, tone volumes, and the like of tones to be generated by this electronic musical instrument are controlled on the basis of parameter data set in the working memory 5. The values of the parameters set in the working memory 5 can be incremented/decremented upon operation of the UP/DOWN operation members on the operation panel 2. More specifically, when a user wants to increment/decrement, e.g., a tone color parameter value, he or she depresses the UP or DOWN operation member present in a block of parameter 1 corresponding to the tone color parameter, shown in FIG. 2. Thus, the increment/decrement means 22 increments/decrements the value of the tone color parameter of parameter data stored in the working memory 5.

When the user wants to change the values of the parameters set in the working memory 5 to preset values stored in the preset memory 5, he or she need only depress the corresponding PRESET operation members on the operation panel 2. More specifically, when the user changes, e.g., the tone color parameter value to a preset value, he or she depresses the PRESET operation member present in the block of parameter 1 corresponding to the tone color parameter, shown in FIG. 2. Then, the preset value supplier means 21 reads out a preset value of the tone color parameter from the preset data stored in the preset memory 6, and supplies it to the working memory 5, thereby renewing the value of the tone color parameter of the parameters stored in the working memory 5 with the readout preset value. The same applies to the remaining tone volume, tone pitch, effect, tempo parameters, and the like. That is, the user need only depress a PRESET operation member in a block corresponding to a parameter of interest on the operation panel 2, thereby setting a preset value in the working memory 5 as the value of the parameter of interest.

As described above, according to the above-mentioned embodiment, the values of the parameter data set in the working memory 5 can be independently changed to corresponding preset values stored in the preset memory 6 upon operation of the corresponding PRESET operation members on the operation panel 2. Therefore, for example, only a tone color parameter value can be changed to a preset value, which is preset according to a user's favor. Thus, tones having a desired tone color, and the like can be easily obtained.

When a preset value is set as a given parameter value, the PRESET operation member in a block corresponding to the given parameter which is to be set to the preset value on the operation panel 2 need only be depressed. Thus, an operation of an operation member for selecting a parameter whose value is to be changed can be omitted, and the PRESET operation member can be depressed with one finger. Therefore, the operation is easy, and operability can be improved as compared to a method wherein a parameter value is changed to a preset value by simultaneously depressing a plurality of operation members with a plurality of fingers.

The present invention has been described with reference to its preferred embodiment. However, the present invention is not limited to the above-mentioned embodiment, and various effective changes may be made on the basis of the technical idea of the present invention. For example, the working memory 5 and the preset memory 6 may be constituted by a single memory.

As described above, according to the present invention, preset values can be independently set as parameter values in units of parameters. In this case, a selection operation of a parameter which is to be set to a preset value, and an operation for instructing to set the preset value can be easily performed by a single operation with one finger.

What is claimed is:

1. A parameter setting apparatus for an electronic musical instrument, for independently setting a plurality of parameters for controlling tones, comprising:

preset memory means for storing a plurality of present values, each corresponding to one of said plurality of parameters;

a plurality of parameter value setting means, each corresponding to one of said plurality of parameters;

each of said plurality of parameter value setting means including an operation member for incrementing a value of the corresponding parameter, a decrementing operation member for decrementing the value of the corresponding parameter, a preset operation member for setting the value of the corresponding parameter to a corresponding preset value; wherein each of said preset operation members sets the value of the corresponding parameter to the corresponding preset value independent of all other preset operation members; and a tone generator for generating a musical tone signal based on the plurality of parameter values;

parameter memory means for storing the plurality of parameter values supplied to said tone generator;

initial value memory means for storing initial values of the plurality of parameters;

means for transferring the parameter initial values to said preset memory means and said parameter memory means upon a power-ON operation.

preset value supplier means for transferring the corresponding preset value stored in said preset memory means to said parameter memory means when said corresponding preset operation member is operated;

preset value renewal means for incrementing or decrementing the corresponding parameter value in said preset memory means upon operation of said corresponding incrementing or decrementing operation member, respectively; and parameter value increment/decrement means for incrementing or decrementing the corresponding parameter value in said parameter memory means upon operation of said corresponding incrementing or decrementing operation member, respectively.

2. The apparatus of claim 1, further comprising mode change means for setting said electronic musical instrument in an edit mode, and wherein when a play mode is selected, said parameter value increment/decrement means is enabled, and when the edit mode is selected, said present value renewal means is enabled.

3. The apparatus of claim 1, wherein said preset memory means and said parameter memory means constitute a single memory.

4. The apparatus of claim 1, wherein an operator selects and sets one of the plurality of parameters to be set to its corresponding preset value with one finger.

5. A parameter setting apparatus for an electronic musical instrument for independently setting a plurality of parameter values, for controlling tones, comprising:

a plurality of parameters value setting means, arranged on an operation panel, each corresponding to one of said plurality of parameters, each of said plurality of parameter value setting means including an incrementing operation member for incrementing the corresponding parameter value, a decrementing operation member for decrementing the corresponding parameter value, and a preset operation member for setting the corresponding parameter value to a corresponding preset value;

increment/decrement means for incrementing or decrementing each corresponding parameter value when said corresponding incrementing operation member or said corresponding decrementing operation member is operated, respectively;

preset value setting means for independently setting the corresponding parameter value to the corresponding preset value when said corresponding preset operation member is operated; and a tone generator for generating a musical tone signal based on the plurality of parameter values;

parameter memory means for storing the plurality of parameter values supplied to said tone generator;

initial value memory means for storing initial values of the plurality of parameters;

means for transferring the parameter initial values to said preset value setting means and said parameter memory means upon a power-ON operation;

preset values supplier means for transferring the corresponding preset value set in said preset value setting means to said parameter memory means when said corresponding preset operation member is operated;

preset value renewal means for incrementing of decrementing the corresponding parameter value in said preset value setting means upon operation of said corresponding incrementing or decrementing operation member, respectively; and parameter value increment/decrement means for incrementing or decrementing the corresponding parameter value in said parameter memory means upon operation of said corresponding incrementing or decrementing operation member, respectively.

6. The apparatus of claim 2, further comprising mode change means for setting said electronic musical instrument in an edit mode, and wherein when a play mode is selected, said parameter value increment/decrement means is enabled, and when the edit mode is selected, said present value renewal means is enabled.

7. The apparatus of claim 2, wherein said preset value setting means and said parameter memory means constitute a single memory.

8. The apparatus of claim 2, wherein an operator selects and sets one of the plurality of parameters to be set to its corresponding preset value with one finger.

9. A parameter setting apparatus for an electronic musical instrument for independently setting a plurality of parameter values, for controlling tones, comprising:

a plurality of parameter value setting means, arranged on an operation panel, each corresponding to one of said plurality of parameters, each of said plurality of parameter value setting means including an incrementing operation member for incrementing the corresponding parameter value, a decrementing operation member for decrementing the corresponding parameter value, and a preset operation member for setting the corresponding parameter value to a corresponding preset value;

increment/decrement means for incrementing or decrementing each corresponding parameter value when said corresponding incrementing operation member or said corresponding decrementing operation member is operated, respectively;

preset value setting means for independently setting the corresponding parameter value to the corresponding preset value when said corresponding preset operation member is operated;

a tone generator for generating a musical tone signal based on the plurality of parameter values;

parameter memory means for storing the plurality of parameter values supplied to said tone generator;

initial value memory means for storing initial values of the plurality of parameters;

means for transferring the parameter initial values to said preset value setting means and said parameter memory means upon a power-ON operation;

preset value supplier means for transferring the corresponding preset value set in said preset value setting means to said parameter memory means when said corresponding increment/decrement means is operated;

preset value renewal means for incrementing or decrementing the corresponding parameter value in said preset value setting means upon operation of said corresponding incrementing or decrementing operation member, respectively.

parameter value increment/decrement means for incrementing or decrementing the corresponding parameter value in said parameter memory means upon operation of said corresponding incrementing or decrementing operation member, respectively;

mode change means for setting said electronic musical instrument in an edit mode, wherein when a play mode is selected, said parameter value increment/decrement means is enabled, and when the edit mode is selected, said preset value renewal means is enabled; and display means for displaying the corresponding parameter value incremented or decremented by said preset value renewal means or by said parameter value increment/decrement means.

* * * * *

UNITED STATES PATENT AND TRADEMARK OFFICE

CERTIFICATE OF CORRECTION

PATENT NO. : 5,288,941

DATED : February 22, 1994

INVENTOR(S) : Sekizuka

It is certified that error appears in the above-indentified patent and that said Letters Patent is hereby corrected as shown below:

Column 6, claim 1, line 4, delete "pres-" and insert —preset—.
line 5, "ent".

Column 6, claim 5, line 4, delete "parameters" and insert —parameter—.
line 32, delete "values" and insert —value—.

Column 7, claim 6, line 1, delete "2" and insert —5—.
Column 7, claim 7, line 1, delete "2" and insert —5—.
Column 7, claim 8, line 1, delete"2" and insert —5—.

Signed and Sealed this

Twenty-eight Day of February, 1995

Bruce Lehman

*Attest:*

BRUCE LEHMAN

*Attesting Officer*

*Commissioner of Patents and Trademarks*